United States Patent [19]

Galvin et al.

[11] 4,331,952

[45] May 25, 1982

[54] REDUNDANT SENSOR ADAPTER

[75] Inventors: Aaron A. Galvin, Lexington; Kevin D. Flynn, Somerville, both of Mass.

[73] Assignee: American District Telegraph Company, New York, N.Y.

[21] Appl. No.: 189,609

[22] Filed: Sep. 22, 1980

[51] Int. Cl.[3] ..... G08B 29/00; G08B 19/00

[52] U.S. Cl. ..... 340/508; 340/506; 340/522; 340/531

[58] Field of Search ..... 340/508, 506, 511, 521, 340/522, 523, 531, 541

[56] References Cited

U.S. PATENT DOCUMENTS

| | | | |
|---|---|---|---|
| 3,074,053 | 1/1963 | McDonough et al. | 340/522 |
| 3,611,335 | 10/1971 | Ogden | 340/522 |
| 3,725,888 | 4/1973 | Solomon | 340/522 |
| 3,786,501 | 1/1974 | Marnerakis | 340/511 |
| 3,801,978 | 4/1974 | Gershberg et al. | 340/522 |
| 4,195,286 | 3/1980 | Galvin | 340/522 |

*Primary Examiner*—John W. Caldwell, Sr.

*Assistant Examiner*—Donnie L. Crosland

*Attorney, Agent, or Firm*—Weingarten, Schurgin & Gagnebin

[57] ABSTRACT

An adapter for a multiwire security and surveillance system which permits the connection of redundant sensors at one location, without affecting the operation of non-redundant sensors at other locations. In one embodiment each of the redundant sensors is coupled to the adapter, such that individual sensor alarm currents are prevented from being applied to the signal wire. In response to simultaneously occuring latched output signals from the redundant sensors, a circuit within the adapter couples to the signal wire the same type alarm condition signal which is provided by the individual sensors. A voltage driver/current sensor circuit is interposed between an associated redundant sensor and the signal line to both sense an alarm condition at the corresponding redundant sensor and to isolate the sensor from the signal line, with the adapter coupling control signals through the associated voltage driver/current sensor circuit to the associated redundant sensor.

11 Claims, 4 Drawing Figures

REDUNDANT SENSOR ADAPTER

FIELD OF THE INVENTION

This invention relates to facility monitoring or surveillance systems and more particularly to an adapter system which permits the utilization of redundant sensors at one location without affecting the normal function of non-redundant sensors at other locations.

BACKGROUND OF THE INVENTION

As illustrated in allowed U.S. patent application Ser. No. 910,534 by Richard E. Crandall, et al, filed May 30, 1978 and assigned to the assignee hereof, there is disclosed a multiwire intrusion detection system in which a number of sensors are coupled in parallel across a multiwire cable which connects the sensors to a central control unit. The central control unit provides a remote indication of an alarm condition as well as provided all necessary signals for the sensors such as carrier, reset, latch, freeze and mode select signals.

The sensors themselves may be of the ultrasonic, infrared or microwave variety, with the particular type of sensor being chosen for the particular type space which is monitored. For instance in the monitoring of hallways, it may be desirable to utilize an infrared sensor, whereas in the monitoring of large areas an ultrasonic sensor may be desirable. The use of microwave sensors may be desirable in the case where the distance from sensor to the area to be monitored is greater than that which would be acceptable when utilizing an ultrasonic sensor.

Situations sometimes arise in which it is desired to provide volumetric protection, but the environment is such that no single sensor can be configured to perform at a low false alarm rate. For example, in an entry foyer of a department store, an ultrasonic detector can be disturbed by air currents leaking around the outside doors. Moreover, a microwave unit can be troubled by reflections and the penetration of the microwave signal through glass, causing sensitivity to vehicles on the street. Passive infrared detectors can be affected by direct or indirect sunlight.

As described in U.S. Pat. No. 4,195,286 issued to Aaron A. Galvin on Mar. 25, 1980, the use of redundant sensors is extremely effective in reducing the false alarm rate associated with a single sensor in a given location. In general what is described in this patent is a system in which two or more sensors monitor the same area. An alarm signal is sent only when an alarm condition is sensed at both sensors. The applications for such a redundant system are their use in very sensitive areas, for example, in nuclear fuel storage facilities, where agency response might have to be massive. Were not some redundancy utilized to combat false alarms, the false alarm rate would be intolerable. Redundant sensors can also be utilized to advantage in very severe environments where volumetric detection is required.

In summary, no matter how reliable a single sensor is, it will produce some measurable level of false alarm through a combination slight misapplication and occurrance of statistically infrequent but possible spurious events. Once the sensor is installed, it is only with extreme difficulty that any measurable reduction in false alarms can be achieved. When a reduction can be achieved, it is usually at a substantially reduced detection likelihood.

More particularly, by requiring the alarming of two or more sensors which have differing false alarm mechanisms, another dimension becomes available to reduce greatly the false alarm likelihood with a minimal sacrifice in intruder detection performance. It can be shown that assuming each detector operates with a probability of detection of 98%, e.g. it will fail to detect intrusion an average of 2% of the time, and assuming that each detector false alarms an average of once in three years and that its typical minimum time to alarm is one second, in which the target or spurious event must exist in the detection zone for at least one second in order to produce an alarm, then the false alarm rate for a redundant system can be shown to be once every 1,000 years.

However, one of the basic difficulties in structuring a system which utilizes redundant sensors at only a few locations compared to the locations covered by the entire system, is the problem of configuring a universal adapter which will permit the system to operate in its normal non-redundant mode without change, while at the same time providing that for those locations at which redundancy is required, redundancy can be achieved very simply with the utilization of an adapter into which the redundant sensors are plugged. Thus it is desirable to have an adapter which can be connected in normal fashion across the multiwire cable utilized in the system, and provide an alarm signal which duplicates the alarm signals normally generated by the single sensors, the existence of which indicates that an alarm condition has been detected at both of the two redundant sensors.

In the past, interface modules have been used to connect different types of sensors to a multiwire cable. One such system is described in U.S. patent application Ser. No. 910,534 filed by Richard E. Crandall et al on May 30, 1975 for a Multiple Sensor Intrusion Detection System and assigned to the Assignee hereof. Here an interface module is provided for each sensor so that different types of sensors can be accomodated. However this interface module does not accomodate redundant sensors.

SUMMARY OF THE INVENTION

In order to provide easy adaptability of multiwire systems for sensor redundancy without increasing the number of wires, an adapter is provided which permits the connection of redundant sensors at one location to the system without affecting the operation of the remaining non-redundant sensors at other locations. In one embodiment a pair of redundant sensors is coupled to the adapter which itself is coupled across the multiwire cable. The multiwire cable typically has a dc power wire, a ground wire, a carrier wire and a signal wire, with the signal wire coupling control signals to the sensors and providing a conduit for an alarm condition signal to be sent back to a central station or control unit. The sensors obtain their power, carrier signal if any, and control signals from the adapter which passes them to the individual sensors. A circuit within the adapter couples to the signal wire the same type alarm condition signal as provided by the individual sensors in response to simultaneously occuring latched output signals from the redundant sensors. The coincidence of these latched signals is determined by an AND gate, the output of which is utilized to actuate a current driver for providing the alarm condition signal which is coupled onto the signal wire.

In a large class of alarm systems, an alarm condition or a monitored analog condition is sensed by providing a current sink at the sensor which draws current from the control unit when actuated. Thus when a sensor detects an alarm condition, a current sink at the sensor coupled to the signal line grounds or partially grounds the signal line, which results in a dramatically large current draw along the signal line. This dramatic increase in current is sensed at the control unit and an alarm is sounded.

In order to prevent one of the redundant sensors from providing an alarm signal back on the signal line, a voltage driver/current sensor circuit is interposed between each redundant sensor and the signal line. The purpose of this circuit the current sensor is to couple to the redundant sensor the same type of signals normally coupled to it, while at the same time both isolating the sensor's alarm circuits from the signal line and intercepting the alarm current from the redundant sensor. When an alarm current from a redundant sensor is sensed, an associated monostable multivibrator in the adapter is triggered, thereby to provide a latched indication of an alarm condition for the length of time it takes for the multivibrator to time out. Upon the simultaneous occurrence of outputs from the multivibrators associated with the redundant sensors, a current sink in the adapter is actuated to draw current from the signal line, thus to generate the same type alarm condition signal produced by the individual sensors and recognized by the system.

DESCRIPTION OF THE DRAWINGS

The invention will be fully understood from the following detailed description taken in conjunction with the accompanying drawings in which.

DETAILED DESCRIPTION

Figure 1:
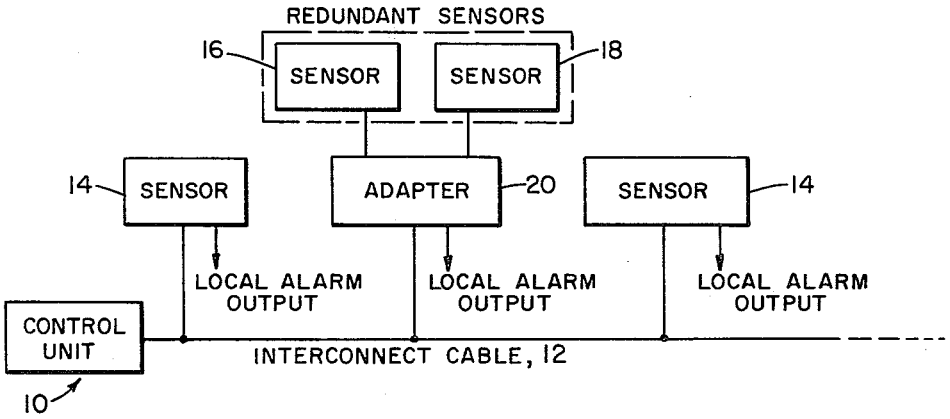
FIG. 1 is a block diagram illustrating the position of the subject adapter between redundant sensors and a multiwire interconnect cable between the sensors and the control unit.

Referring now to FIG. 1, a surveillance system in general includes a control unit 10, a multiwire interconnect cable 12 and a number of sensors, normal sensors 14, and a pair of normal sensors 16 and 18 utilized as redundant sensors for monitoring activity at a given location.

As described hereinbefore, the interconnect cable connects normal sensors at a variety of different locations to a central control unit, wherein the normal sensors monitor a given condition and transmit information concerning the monitored condition back to the control unit. For this purpose the interconnect cable may be a quad cable including four wires which, in one embodiment may include a ground wire, a power wire, a carrier wire and a signal wire. The utilization of these wires will be described more completely in connection with FIG. 2. However with respect to FIG. 1, it will be appreciated that individual normal sensors have an operation determined by the signals on the quad cable and it is important, when retrofitting the system with redundant sensors that the signals and the functioning of these normal sensors not be adversely affected.

With respect to the redundant sensors, these sensors are also normal sensors in the sense that they individually function in exactly the same way as the aforementioned normal sensors. Thus if the sensor is an infrared sensor, it may sense an intrusion due to the detection or alteration of infrared energy within the monitored area. The normal sensors may be microwave intrusion detection sensors, may be ultrasonic sensors, or may include such foil or contact sensors as may be appropriate for monitoring window openings or threshold crossings. In the case of the rather simple foil or contact sensors, a carrier need not be provided to the sensor, but its alarm indication will always be transmitted along the signal wire.

In order to reduce the false alarm rate in volumemetric monitoring, redundant sensors either monitoring different areas of the volume or sensing different physical phenomena may be utilized in order to prevent false alarm signals from being placed on the signal wire. For instance, simultaneous occurrence of false alarm phenomena for two different types of sensors is extremely unlikely and therefore if an alarm condition signal is only provided when both of these sensors indicate that an alarm condition has been monitored, the false alarm rate of the system will be drastically reduced.

As mentioned, the utilization of redundant sensors for such false alarm is described in U.S. Pat. No. 4,195,286. However in order to provide for system flexibility and easy retrofitting, the subject system is provided with a specialized adapter 20 the purpose of which is two-fold. It is a purpose of the adapter to connect the redundant sensors to the system in such a way that an alarm condition signal of the type normally sent to the control unit is sent only upon the simultaneous occurrence of output from each of the redundant sensors. It is a second function of the adapter to provide all of the normal power control and carrier signals to the redundant sensors while at the same time isolating the outputs of the redundant sensors with respect to the signal wire. This means that although one sensor may provide an alarm condition signal it will not be coupled to the signal wire unless a simultaneously occurring alarm condition signal is generated by the other of the redundant sensors.

Not only does the adapter provide for the connection of the redundant sensors to the system but it also provides that is so doing none of the other functions of the system are adversely affected so that redundant sensors can be connected with ease at any location in the system.

EXAMPLE OF A FOUR WIRE SYSTEM

Before describing the adapter which is utilized to connect the redundant sensors to the system, a typical four wire system is now described. It will be apparent from the description hereinafter, that the attaching of the subject adapter across the interconnect cable does not affect the normal operation of the system. This operation will now be described.

The system described by way of example in general operates in a number of different modes. The different modes allow the determination of which sensor produced an alarm signal, investigation of the protected area after occurrence of an alarm signal without disturbing the alarm determination, and resetting of the system. The modes are designated reset, latch and freeze, which refer not only to modes but also to control signals to effectuate these functions. In the reset mode, which is the normal alarm mode, each indicator at a sensor is reset an will indicate the presence of an alarm condition as it occurs. After cessation of the alarm signal the indicator will automatically reset. Thus, the reset mode is the normal mode in which an alarm indication is provided only during the presence of an alarm signal. In the latch mode, any sensor which detects an alarm condition and produces an alarm signal also triggers an associated indicator which remains on or "latched" even after the alarm signal has ceased. In the freeze mode, the outputs of all of the indicators can be maintained in their state at the time this freeze mode is initiated such that the then state of the sensors can be investigated. This mode is useful for example to permit investigation of premises without having the investigator's movement in the protected areas cause change in the state of the indicators.

Figure 2:
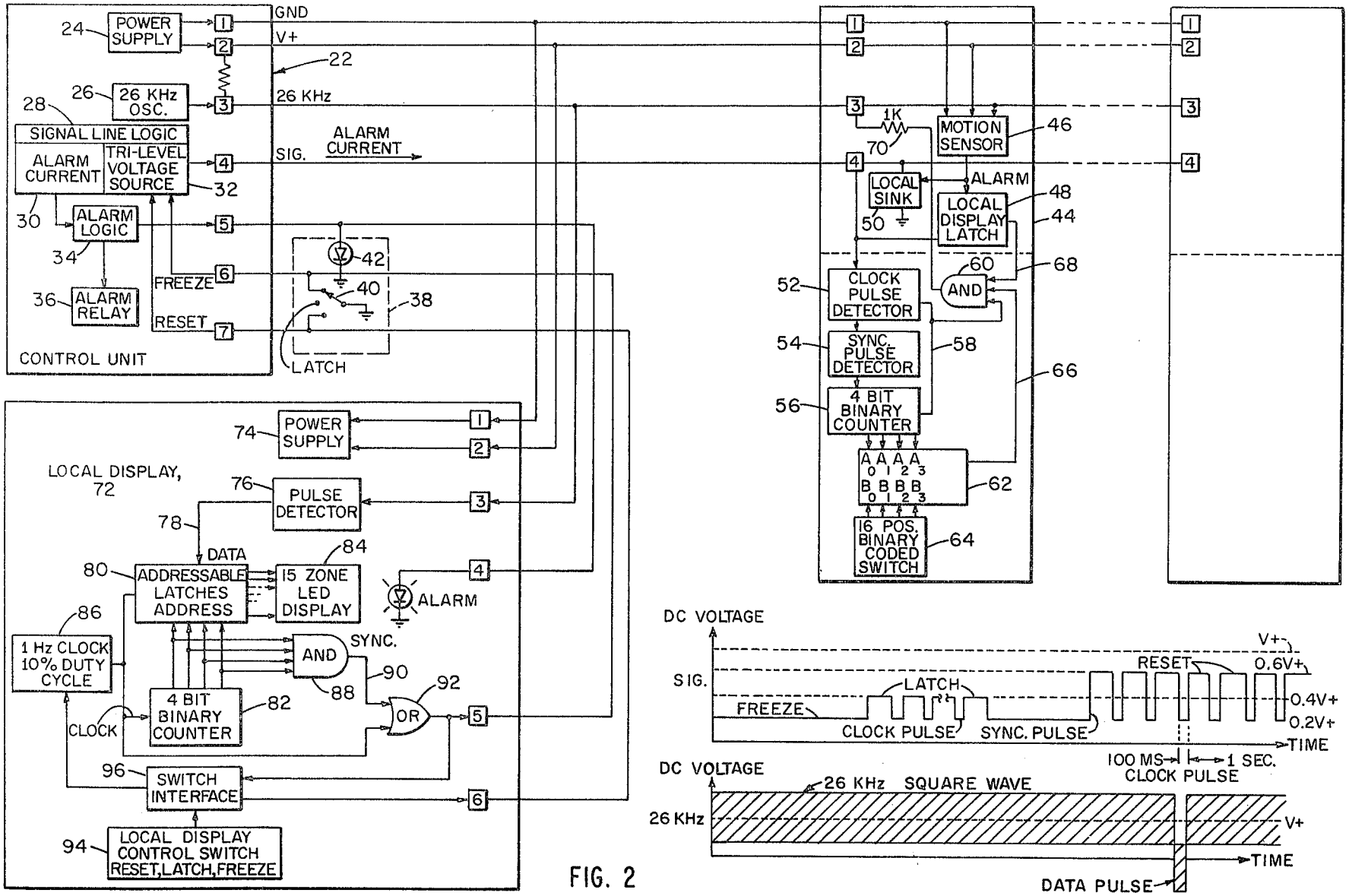
FIG. 2 is a block diagram of one type of surveillance system illustrating sensors connected to a four wire cable, and the control signals coupled to the sensors.

Referring to FIG. 2 a control unit 22 is provided with a power supply 24, a 26 KiloHertz oscillator 26 and a signal line logic unit 28 which includes an alarm current detector 30 and a tri-level voltage source 32. An alarm logic unit 34 is connected to the alarm current detector and an alarm relay 36 is driven by the alarm logic unit. The outputs of the power supply are to terminals 1 and 2 as illustrated; the output of oscillator 26 is connected to terminal 3 and the output of signal line logic unit 28 is connected to terminal 4. If the system is not retrofitted for non-home run zoning, a unit 38 is provided which includes a three position single pole, center-off switch 40 having its outer contacts coupled respectively to terminal 6 and 7 of control unit 22. With respect to indicating device 42, whenever an alarm condition signal is indicated at the control unit, this device is actuated.

With respect to switch 40, the grounding of terminal 6 or 7 results in a different dc voltage level being applied at terminal 4. With the switch in the position shown, a dc level indicating a freeze level is provided at terminal 4. In the center position, which is the off position, the latch level signals are provided and in the lower position a reset level signal is applied at terminal 4.

Referring now to one of the sensors of such a system, the sensor here is illustrated within box 44 to include a motion sensor 46 connected for its power supply and ultrasonic signals to terminals 1, 2 and 3 as illustrated. The output of the motion sensor is in general coupled to a local display latch circuit 48 and to a current sink 50 which upon being provided with an alarm signal draws current from the signal line as discussed below.

In order to provide such a system with a non-home run zoning indication, in which the zone of an actuated sensor is annunciated at the control unit without running additional wires, sensor 44 is provided with a clock pulse detector 52 coupled to a sink pulse detector 54, coupled in turn to a four bit binary counter 56, with the output of the clock pulse detector also coupled over line 58 to clock the four bit binary counter and to an AND gate 60 which is a three input terminal AND gate.

The output of the binary counter is coupled to a four bit magnitude comparator 62 which is in turn driven by a 16 position binary coded switch 64.

In operation, the clock pulse detector detects the negative-going portions of the signals on the signal line corresponding to the beginning of a freeze pulse which in the subject system, is generated on a periodic basis. The output of the clock pulse detector is fed to the sink pulse detector which detects a long freeze pulse for resetting the four bit binary counter. Otherwise the signals from the clock pulse detector are fed directly to the binary counter for clocking it.

It will be appreciated that the clock pulses as detected by pulse detector 52 are applied as a clock pulse to counter 56 via line 58, with the signal from the sink pulse detector 54 being only provided during the occurrence of a long freeze pulse.

The four bit magnitude comparator 62 functions as follows. When the output of the four bit binary counter equals that code which is set by the 16 position binary coated switch, then an output signal is provided over line 66 to AND gate 60. The other input to AND gate 60 is an output from local display latch circuit 48, the occurrence of which indicates an alarm having occurred at the sensor. This is applied over line 68.

Upon the simultaneous occurrence at AND gate 60 of a clock pulse which is in the nature of the normal periodically generated freeze pulse, an output from the four bit magnitude comparator, and an alarm condition signal, AND gate 60 is actuated to draw current from terminals 3 of the sensor. This provides a negative-going voltage superimposed on the 26 kiloHertz signal on the signal line. This is accomplished by providing a 10 K resistor 70 between the output of AND gate 60 and sensor terminal 3. It will therefore be appreciated that an alarm condition signal is now available not only on the signal line at control unit terminal 4, but is also available on the 26 KiloHertz line at control unit terminal 3.

The zone indication local display add-on 72 for the non-home run zoning for local display 72 is connected as can be seen across terminals 1, 2 and 3 of the control unit. Unit 38 is eliminated and terminals 5, 6 and 7 of the control unit are coupled to terminals 4, 5 and 6 respectively of local display 72. It will be appreciated that local display 72 includes 6 terminals and is connected to 6 terminals of the control unit.

Power for local display 72 is provided via terminals 1 and 2 thereof to a power supply 74 internal to the display. Thus terminals 1 and 2 of the local display unit are coupled to terminals 1 and 2 of the control unit.

Terminal 3 of the local display is connected at terminal 3 of the control unit and is utilized to detect alarm condition signals. In order to accomplish this, a pulse detector 76 is coupled to terminal 3 of the local display and it is utilized to sense the aforementioned negative-going voltage on the carrier line. This is done conventionally by the utilization of filtering circuits and threshold detecting.

The output of detector 76 is applied over line 78 to addressable latches 80 which are driven by a four bit binary counter 82 of similar nature to the four bit binary counter 56 in the sensors. The outputs of the addressable latch circuit are applied to a 15 zone LED display 84.

The local display unit is driven by a one Hertz clock 86 which has a 10% duty cycle. The output of clock 86 clocks four bit binary counter 82 and is also connected to the addressable latches. The output of binary counter 82 is provided to a four input AND gate 88 for generating the sink pulse, e.g. the elongated freeze pulse. This is applied to over line 90 to OR gate 92, the output of which is routed to terminal 5 of the local display which is connected to terminal 6 of the control unit. This is the freeze pulse line. Sending regular clock pulses over the freeze pulse line drives the tri-level voltage source to produce the low voltage level freeze pulses on a regular basis, which freeze pulses are the clock pulses for the four bit binary counter in the sensors. Thus it will be seen that the four bit binary counters in the local display and the sensors are driven simultaneously by the freeze pulses.

Local display 72 is also provided with a local display control switch to provide for either reset, latch or freeze signals. This switch is diagrammatically illustrated at 94. The output of this switch is provided to a switch interface 96. Normally the local display control switch 94 is in the latch position. In this position, there is no signal applied to terminal 6 and the freeze pulses which are the clocking pulses are transmitted from local display at terminal 5 to terminal 6 of the control unit for the sequential actuation of the sensors. When it is desirable to reset the entire system, switch 94 is switched such that terminal 6 is grounded. However, ground is released when the output of OR gate 92 is low such that clock pulses continue to be generated over the signal wire. When it is desirable to freeze the system, switch 94 is switched to the freeze position which in essence freezes clock 86. When this is done, a continuous sink pulse is provided which resets all of the counters to 0.

Referring to the waveforms to the lower right of this figure, it can be seen that initially there is a long freeze pulse which resets the counters. This is followed by a latch level signal followed by a clock pulse, followed by another latch level signal. It will be appreciated that short freeze pulses are generated until such time as 16 have been generated, at which point a sink pulse, which is an elongated freeze pulse, is generated. The system may be reset at any time by providing a reset signal. As illustrated the reset signal is momentarily interrupted by clock pulses. The reason the clock pulses are allowed to override the reset pulse is to maintain the clocking of all the counters, while resetting local display latches.

With respect to the freeze pulses, the reason for choosing the freeze pulses as a system clock, is because the freeze pulses will not reset the local display and will not interfere in any noticable way with the walk testing of the equipment as long as the pulses are kept short and relative to the perceived operation of the local display indicated. The reason for using the negative-going voltage for the clock pulses is because the original protocol selected for the signal line used a negative-going pulse for freezing the display. Momentary freezes of the local display will in no way interfere with the walk testing and the equipment as long as they are kept at the 100 millisecond type time as indicated in the timing diagram.

Note, the sink signal is used to reset the counters that are used for the non-home run display. Moreover, the non-home run display runs independently of the local display latch and it is used to provide a remote indication of what the state of this latch is without disturbing any other functions.

The reset pulse is to reset the local display latch. In the embodiment illustrated, the reset is a dc level which is used to reset the local display latch, whereas the sink pulse is utilized to reset the counters for the non-home run zoning. The sink pulse occurs once every 16 clock pulses and resets the counter to insure even if a stray noise pulse is fed into the system that it would not interfere with the performance of the remote displays for more than one cycle of the clock count. Thus, each cycle of the binary counters is reset to start over again in each cycle.

REDUNDANT SENSOR ADAPTER

Having described a rather complicated but nonetheless typical surveillance system, it is the purpose of the subject adapter to retain the operation of the aforementioned system while at the same time permitting the connection of redundant sensors to the system.

Figure 3:
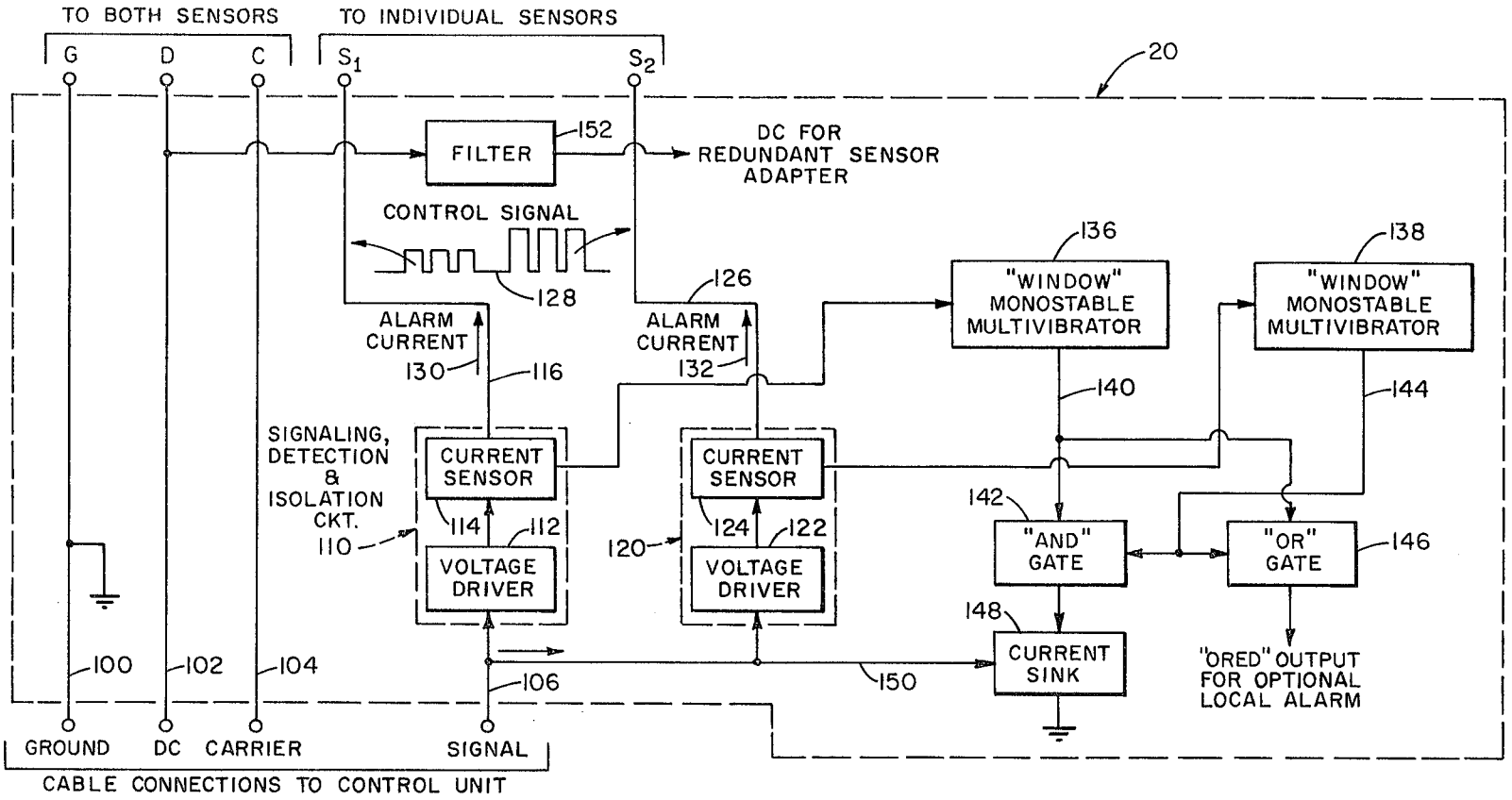
FIG. 3 is a block diagram of the circuitry within the adapter for providing an alarm condition signal responsive to alarm conditions being sensed at both of the redundant sensors coupled to the adapter; and, FIG. 4 is a block diagram of the current sensor voltage driver combination of FIG. 3.

Assuming two redundant sensors to be coupled to the system, with the sensors being labelled $S_1$ and $S_2$, and referring now to FIG. 3, with the ground line designated 100, the dc line designated 102, the carrier line designated 104 and the signal line designated 106, adapter 20 includes a signaling, detection and isolation circuit 110 coupled to signal line 106. These circuits include a voltage driver 112 coupled to a current sensor 114. One output of current sensor 114 is applied over line 116 to the signal line input of sensor $S_1$.

Likewise a signaling, detection and isolation circuit 120 includes a similar voltage driver 122 coupled to a similar current sensor 124 which in turn has an output coupled via line 126 to sensor $S_2$.

Lines 100, 102 and 104 are coupled directly to both sensors as illustrated.

It will be appreciated that the control signals on signal line 106 are in the form of voltage levels which are amplified by the voltage driver and passes through the current sensor such that the control signals on the signal line to sensor $S_1$ and $S_2$ are as illustrated by waveform 128 which corresponds to the control signals illustrated in connection with FIG. 2. As such they may be tri-level signals.

Having provided the individual sensors with control signals along their normal signal lines, when either sensor $S_1$ or $S_2$ senses an alarm condition, alarm current is drawn from respective line 116 or 126 as illustrated by arrow 130 or arrow 132. The drawing of current along an associated line results in a signal being provided from the associated current sensor along a corresponding line 132 or 134 to an associated "window" monostable multivibrator 136 or 138.

The term "window" is utilized in connection with the monostable multivibrator to indicate that the monostable multivibrator is set up to provide an output pulse for a substantial length of time once the multivibrator has been triggered having a duration "window" so that a redundant alarm condition can be monitored. Thus, for example, the output of the monostable multivibrator may remain high for as long as one second after an associated current sensor provides a signal to trigger the monostable multivibrator.

The output of monostable multivibrator 136 is applied over line 140 to one terminal of a two terminal AND gate 142, whereas the output of monostable multivibrator 138 is applied over line 144 to the other input terminal to this AND gate.

As one option the outputs of both monostable multivibrators are applied to an OR gate 146, the output of which may be provided for an optional local alarm to indicate that one or both of the redundant sensors has detected an alarm condition.

The output of AND gate 142 is applied to a current sink 148 which draws current from line 150 when an alarm condition is sensed at both of the sensors, whether it be simultaneously or one after another within a short period of time, e.g. one second in the illustrated case.

The drawing of currents from a line 150 couples an alarm signal to signal line 106 which is the type of signal recognized by the system.

As can be seen, the interposition of the signaling, detection and isolation circuit between signal line 106 and the signal line to the individual sensors provides the appropriate signaling to the sensors, provides detection of alarm currents generated by the sensors, and also isolates the sensors from signal line 106 so that drawing of alarm current by any one of the sensors will not automatically place an alarm current signal on line 106.

As a matter of convenience, a filter 152 may be coupled within the adapter to the dc power line to supply filtered dc power for the redundant sensor adapter. This eliminates any line noise which would interfere with the operation of the current sensing and monostable multivibrators that would give false alarm indications.

Figure 4:
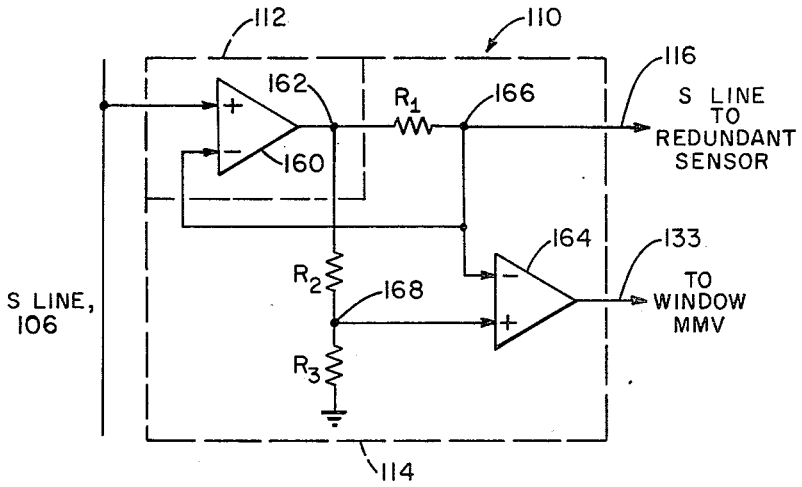

Referring now to FIG. 4, in one embodiment, the signaling, detection and isolation circuits, circuit 110 or 120 may include a high gain operational amplifier 160 as the voltage driver. In this embodiment, the non-inverting input of the amplifier is coupled to S line 106, whereas an output terminal 162 is coupled directly back to the inverting input terminal through current sense resistor R1. The output of the amplifier is applied through a resistor R1 to line 116 which serves as the S line to redundant sensor $S_1$. A voltage dividing circuit comprising resistors R2 and R3 coupled between output terminal 162 and ground, provides an input to an operational amplifier 164 which serves as a current threshold detector. The inverting input of amplifier 164 is coupled to a point 166 on the opposite of resistor R1 to the output terminal 162 of amplifier 160. The non-inverting input of amplifier 164 is coupled to the midpoint 168 between resistor R2 and R3. The output of amplifier 164 is coupled to line 133 running to window monostable multivibrator 136 of FIG. 3.

In operation, if sensor $S_1$ has not detected an alarm condition, there is no load applied to line 116. With no load, there is no voltage drop across R1, but there will exist a voltage drop across R2 and R3 to ground since the voltage driver will have at its output some predetermined voltage. The voltage determined by the voltage divider R2 and R3 existant at point 168 effectively turns off operational amplifier 164 by a predetermined amount. Thus amplifier 164 is biased off under normal circumstances.

When sensor $S_1$ is actuated by an alarm condition, current is drawn from line 116 which results in a voltage drop across resistor R1. When this voltage drop exceeds that determined by the resistor dividing network R2 and R3, amplifier 164 provides an output voltage which triggers the window monostable multivibrator to which it is coupled.

As can be seen, the voltage level signals transmitted along the S line are provided through resistor R1 so as to provide the appropriate signaling to the associated sensor. The voltage driver also serves to isolate sensor $S_1$ from S line 106. Concomitantly, amplifier 164 serves as a current threshold detector with the threshold being set from the output of the voltage driver.

Having above indicated a preferred embodiment of the present invention, it will occur to those skilled in the art that modification and alternatives can be practiced within the spirit of the invention. It is accordingly intended to define the scope of the invention only as indicated in the following claims.

What is claimed is:

1. Apparatus for a facility monitoring system having a multiwire interconnect cable which includes a signal line, said apparatus permitting the connection of redundant sensors at one location to the multiwire interconnect cable without affecting the operation of non-redundant sensors connected to the interconnect cable, comprising:

an adapter module adapted to be coupled between the redundant sensors and the multiwire interconnect cable, said adapter module including means interposed between each of said redundant sensors and said signal line for sensing an output signal from a corresponding redundant sensor and for isolating said sensor so that its output signal is not applied to said signal line; and, means for coupling to said signal line a predetermined signal upon the simultaneous or sequential occurrence of sensed output signals from said redundant sensors, said signal line carrying control signals and said sensing and isolating means including means for coupling the control signals carried by said signal line to a corresponding redundant sensor.

2. The apparatus of claim 1 wherein system sensors produce a predetermined output signal and wherein said predetermined signal is the same type output signal as generated by system sensors.

3. The apparatus of claim 1 wherein said system has a number of lines in said interconnect cable and wherein said adapter module includes means for directly connecting all lines but said signal line to said redundant sensors.

4. The apparatus of claim 1 wherein said output signal is an alarm condition indicating signal.

5. The apparatus of claim 1 wherein said sensing and isolating means includes a voltage driver and a current sensor coupled to said driver.

6. The apparatus of claim 5 wherein said current sensor includes a current sense resistor and wherein said voltage driver includes a high gain operational amplifier having its non-inverting input coupled to said signal line and having its output coupled to its inverting input through said current sense resistor.

7. The apparatus of claim 6 wherein said current sensor includes said current sense resistor coupled between the output of said voltage driver and said corresponding redundant sensor, a second operational amplifier having an inverting input coupled to the end of said resistor which is coupled to said corresponding redundant sensor, and means coupled to the non-inverting input to said second operational amplifier for providing an offset voltage from the output of said first mentioned operational amplifier.

8. The apparatus of claim 7 wherein said offset voltage providing means includes a voltage dividing circuit interposed between the output of said first mentioned operational amplifier and ground.

9. The apparatus of claim 1 wherein said means for coupling said predetermined signal to said signal line includes latch circuits, one each coupled to a sensor output signal sensing means and means for generating said predetermined signal responsive to simultaneous outputs from said latch circuits.

10. The apparatus of claim 9 wherein each latch circuit includes a monostable multivibrator actuated by an output from a corresponding sensor output signal sensing means.

11. The apparatus of claim 10 wherein each of said monostable multivibrators is set to time out a predetermined time after actuation.

* * * * *

UNITED STATES PATENT AND TRADEMARK OFFICE

CERTIFICATE OF CORRECTION

PATENT NO. : 4,331,952

DATED : May 25, 1982

INVENTOR(S) : Aaron A. Galvin and Kevin D. Flynn

It is certified that error appears in the above–identified patent and that said Letters Patent are hereby corrected as shown below:

Column 1, line 19, "provided" should read --providing--;

Column 2, line 40, "accomodated" should read --accommodated--;

Column 2, line 41, "accomodate" should read --accommodate--;

Column 3, line 42, "sensors." should read --sensors;--;

Column 4, line 50, "is" should read --in--;

Column 5, line 5, "reset an will" should read --reset and will--

Column 7, line 43, "noticable" should read --noticeable--.

Signed and Sealed this

*Twenty-first* Day of *December 1982*

[SEAL]

*Attest:*

GERALD J. MOSSINGHOFF

*Attesting Officer*

*Commissioner of Patents and Trademarks*